US005429321A

United States Patent [19]

Skyba

[11] Patent Number: 5,429,321

[45] Date of Patent: Jul. 4, 1995

[54] STORAGE AND DISPENSING APPARATUS FOR COILED ARTICLES

[76] Inventor: H. Kurt Skyba, Rte. 2, Box 330, Wild Rose, Wis. 54984

[21] Appl. No.: 855,240

[22] Filed: Mar. 23, 1992

[51] Int. Cl.[6] ..... B65H 75/36

[52] U.S. Cl. ..... 242/591

[58] Field of Search ..... 242/85.1, 96, 591; 191/12.2 R; 24/115 H, 115 K, 129 R, 129 B; 248/304–306; 239/195, 198, 273

[56] References Cited

U.S. PATENT DOCUMENTS

| | | | |
|---|---|---|---|
| 2,709,028 | 5/1955 | Cottar | 242/96 |
| 3,086,723 | 4/1963 | Meeks | 242/96 |
| 3,290,453 | 12/1966 | Jensen | 242/85.1 |
| 3,907,236 | 9/1975 | Sims, Jr. | 242/85.1 |
| 4,688,739 | 8/1987 | Moore | 242/85.1 |
| 4,778,125 | 10/1988 | Hu | 242/85.1 |
| 4,779,815 | 10/1988 | Moore et al. | 242/85.1 |
| 4,779,816 | 10/1988 | Varlet | 242/96 |
| 4,934,625 | 6/1990 | Richardson | 242/85.1 |
| 4,997,997 | 3/1991 | Moore | 242/85.1 |
| 5,064,067 | 11/1991 | McAllister et al. | 242/85.1 X |

FOREIGN PATENT DOCUMENTS

| | | | |
|---|---|---|---|
| 2816266 | 10/1979 | Germany | 242/85.1 |

*Primary Examiner*—John P. Darling

*Attorney, Agent, or Firm*—Ryan, Kees & Hohenfeldt

[57] ABSTRACT

A device for receiving, storing and redispensing a flexible elongated article having a circular cross-section with a generally uniform diameter such as a rope, electrical cord or hose is provided. The devices have a body portion containing a slot for sequentially receiving single loops of the elongated article. A bracket, slot or aperture is provided as means for attaching the device to a supporting surface. The supporting surface can be a wall or post, a belt worn around the waist of a person, or, in the case of an electrical cord, a portion of the cord adjacent to an electrical appliance to which it is attached. The width of the slot at its narrowest portion is sufficiently less than the diameter of the elongated article to restrain movement thereof along the lineal axis of the elongated article while permitting insertion and removal of the article in said slot in a direction perpendicular to that axis. The slot having a raised portion, preferably along the center of the slot, for engaging the elongated article which raised portion has a width substantially less than the overall width of the slot.

14 Claims, 5 Drawing Sheets

STORAGE AND DISPENSING APPARATUS FOR COILED ARTICLES

BACKGROUND OF THE INVENTION

1. Field of the Invention

The present invention relates to apparatus for storing and dispensing coiled articles. More particularly, the invention relates to a coiled article containing and dispensing assembly in combination with an elongated coiled article such as a water or pneumatic hose, electrical cord or rope.

2. Background of the Art

Various devices such as reels have been provided in the prior art for winding and subsequently unwinding and dispensing coiled articles such as electrical cords, garden hoses, rope, pneumatic hoses and the like.

Examples of recently proposed devices include the structure shown in U.S. Pat. Nos. 4,688,739 and 4,997,997 issued to Moore. These patents disclose a retaining and dispensing device in which a slot wider than the diameter of the coiled member is utilized but the width is less than twice the diameter thereof so that only a single coil can be wound thereon. Such devices have, however, suffered from a tendency of the coiled article to slip linearly so as to become tightened about the device, thus interfering with removal of the coiled article from the device.

SUMMARY OF THE INVENTION

It is the principal object of the present invention to provide a novel assembly, in the form of several related embodiments, that enables winding of a coiled material on the assembly in such a manner that endwise movement thereof is restricted, but in connection with which sideways movement of the coiled article into or out of a slot is comparatively unrestricted.

Briefly summarized, the invention provides a device for receiving, storing and redispensing a flexible elongated article such as a rope, electrical cord or hose. The devices have a body portion containing a slot for sequentially receiving single loops of the elongated article. A bracket, slot or aperture is provided as means for attaching the device to a supporting surface. The supporting surface can be a wall or post, a belt worn around the waist of a person, or, in the case of an electrical cord, a portion of the cord adjacent to an electrical appliance to which it is attached. The slot has a constricted portion along its length, which may be formed by aligned ridges along the opposed faces of the slot. The width of the slot at its constricted or narrowest portion is sufficiently less than the diameter of the elongated article to restrain movement thereof along the lineal axis of the elongated article while permitting insertion and removal of the article in said slot in a direction perpendicular to that axis. The constricted portion of the slot is preferably located along the centers of the opposed faces of the body portions defining the slot. The constricted portion preferably includes ridges for engaging the elongated article which ridges have a width substantially less than the overall thickness of the walls and are raised relative to the shoulders of the faces of the slot.

In accordance with a further aspect of the invention the slot is provided with a restriction at the open end thereof or, alternatively, means for closing said end.

In the case where the device is provided in a form for carrying a coil of rope or cord, for example, by a hunter, the attaching means can comprise a slot in the side of the body portion opposite the elongated article receiving slot which is adapted to fit over a belt worn around the waist of the user. Further, the belt engaging slot is oriented so as to hold the rope receiving slot in a generally vertical position with the open end oriented upwardly, and the body portion is provided with a second belt receiving slot adapted to attach said device to the belt of a user with the rope engaging slot pointed generally downwardly for dispensing of the rope.

In accordance with further embodiments, the attaching means is in the form of a bracket adapted to be attached to a wall, post or similar surface, for example, when the device is used to receive and dispense a water or pneumatic hose or an electrical cord. In accordance with yet a further aspect of the invention, provision is made for enabling positioning of the slot in a vertical orientation for receiving the article and is tiltable downwardly to a horizontal orientation for dispensing the article. In accordance with a still further aspect, the device can easily be detached from the mounting bracket so that the device can be carried to another location for unwinding. The body portion of the device can be provided with a generally vertical slot into which a removable pin is fitted for engaging the slot. In this case, raising of the device so that the bottom of said slot engages the pin enables pivoting downwardly of the device so that the article receiving slot is pivoted into a horizontal position.

In accordance with yet a further aspect of the invention the body portion of the device on opposite sides of the slot is of a progressively increasing width toward the closed bottom of the slot. This configuration assists in retaining the wound article, such as a garden hose, in a single coil, avoiding overlapping of the coils and thereby facilitating unwinding of the article.

In accordance with a still further aspect, the attaching means is a clamp adapted to be secured to opposite sides of an electrical cord. The cord can then readily be wound on the device near the point of attachment of the cord to a tool or appliance to which it is connected.

The invention preferably is used for storage and dispensing of elongated articles having a circular cross-section with a generally uniform diameter. However, other such articles such as electrical cords which typically have a flattened oval shape can be stored and dispensed using the invention. In addition to being flexible in the sense that the articles can be bent and coiled, the articles should have a compressible surface in order to provide the advantages of the invention.

DRAWINGS

The invention will be further set forth in the following detailed description and accompanying drawings wherein.

DETAILED DESCRIPTION

Figure 1:
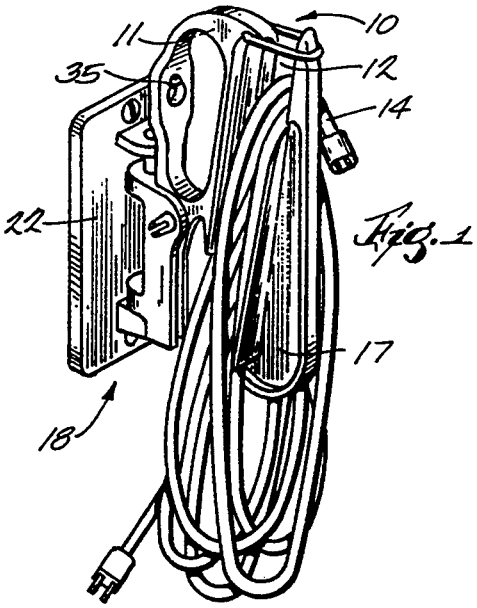
FIG. 1 is a perspective view of the one embodiment of the invention with an electrical cord wound thereon.

Referring to FIG. 1 there is seen a coil member storage and dispensing device 10 that includes a body portion 11 that is provided with a slot 12 for sequentially receiving single loops of the elongated coiled article. In the illustration the coiled article consists of an electrical cord 14 of circular cross section. Body portion 11 preferably includes an opening 15 that forms a handle on the rear side thereof for ease in grasping and lifting the device. Body portion 11 is generally formed from a single molded plastic part having opposed sides 16 and 17 that define a slot 12.

A mounting bracket assembly 18 is provided for pivotally mounting device 10 on a supporting surface such as a post or wall. Dispensing device 10 is secured to bracket assembly 18 by means of a pin 20. Bracket assembly 18 includes a wall mount plate 22 having a hole 23 therein for securement to a wall by means of a screw or simply by placing the same over a nail extending from the wall or a post. A yoke portion 24 adapted to support body portion 11 is provided with holes 26 for receiving pin 20. Body portion 11 is provided with an elongated slot 28 for receiving pin 20. In the preferred embodiment pin 20 is provided with a slightly expanded tip portion which may be provided with a slot 21. This provides a convenient means for snapping pin 20 into holes 26 to provide an appropriate amount of resistance against removal of the pin.

Figure 5:
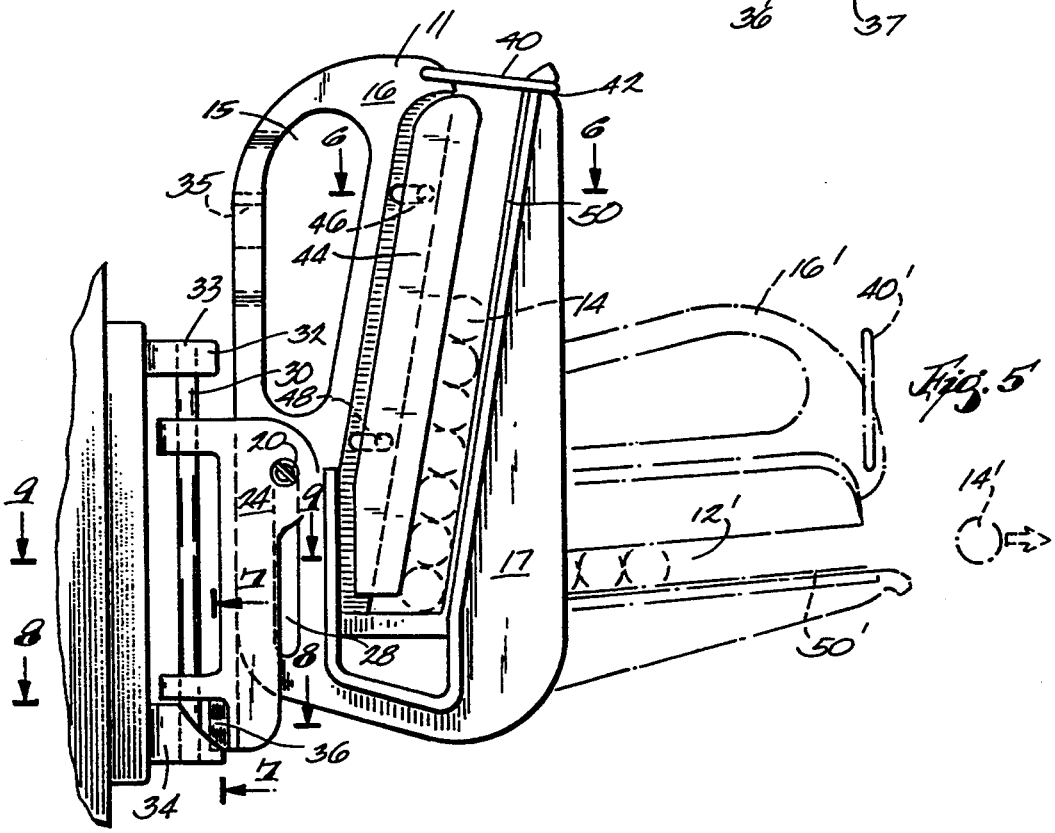
FIG. 5 is a side view of a modified embodiment of the device wherein the width of the slot is adjustable showing coils of a cord thereon in phantom and also showing the device in the dispensing position in phantom.

Slot 28 provides a means by which the dispensing unit 10 remains in an upright position when the top of slot 28 is in contact with pin 20. However, as is seen in FIG. 5, when body portion 11 is lifted so that the bottom of slot 28 engages pin 20 the body portion 11 can be pivoted downwardly as shown by phantom lines 11' for dispensing of elongated article 14'.

Figure 2:
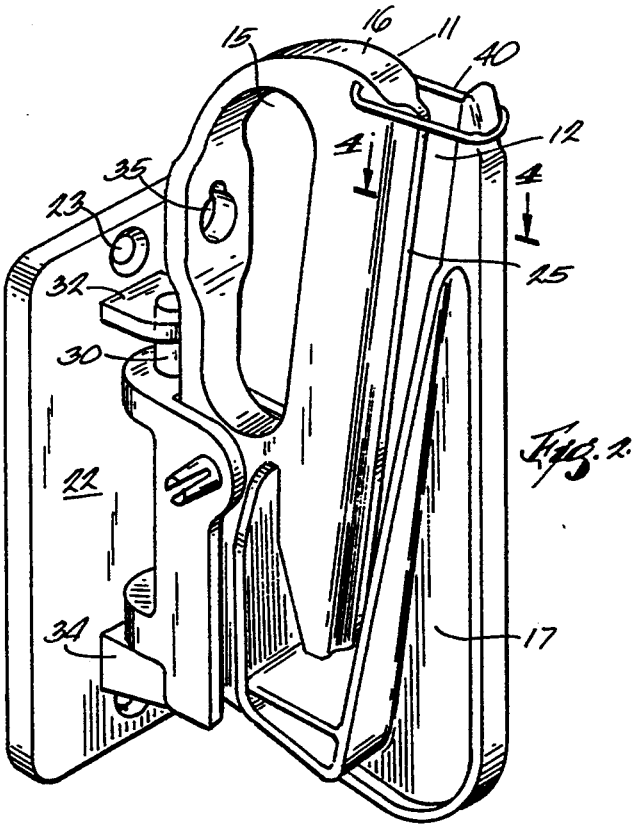
FIG. 2 is a perspective view of the device of FIG. 1 with the electrical cord omitted.
Figure 4:
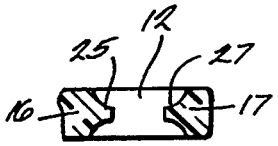
FIG. 4 is a cross-sectional view taken along Line 4—4 of FIG. 2.
Figure 3:
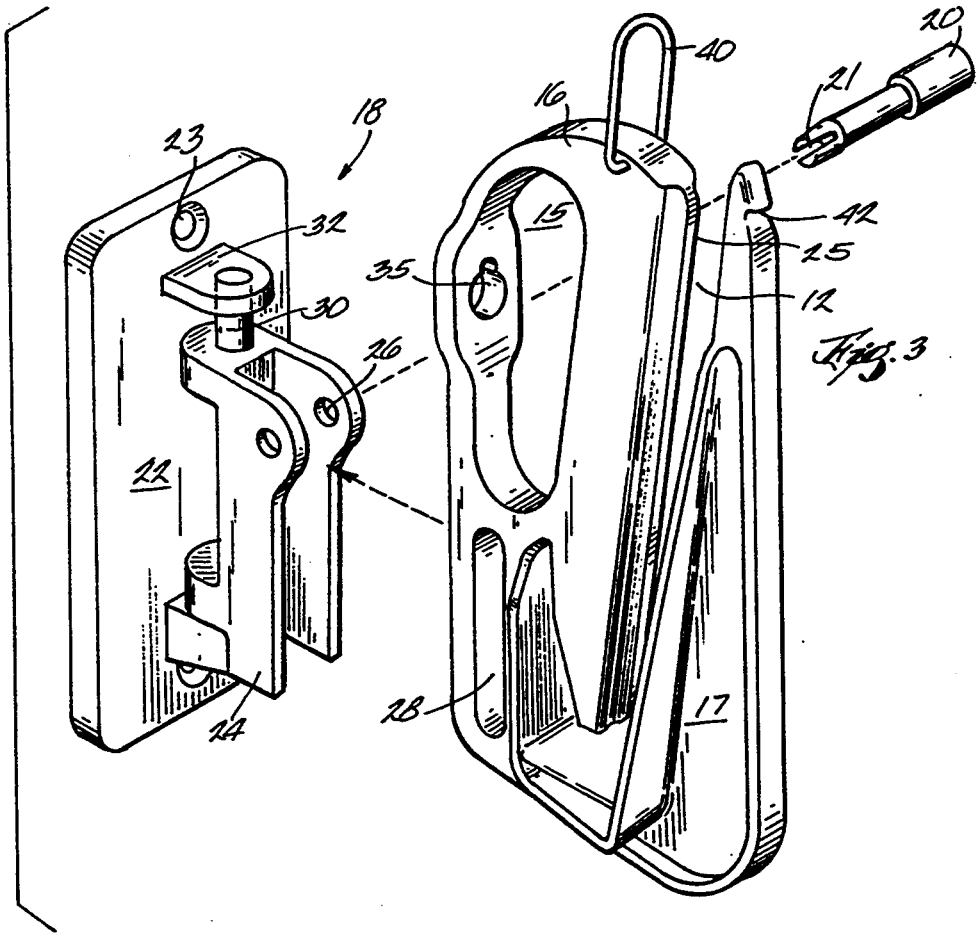
FIG. 3 is a knocked-down perspective view of the device of FIG. 2 illustrating the manner of assembly thereof in greater detail.
Figure 10:
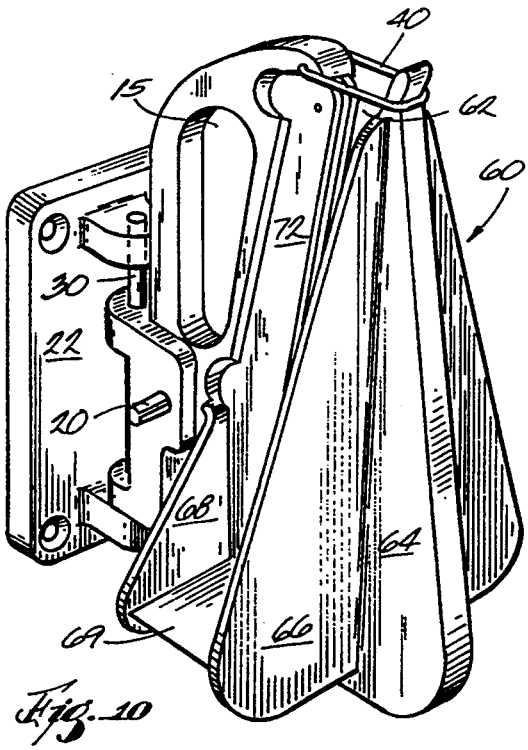
FIG. 10 is a perspective view of a further embodiment of the invention adapted for storage in dispensing of a garden hose.

As seen in FIG. 4, the edges 16 and 17 of body portion 11 that define slot 12 are provided with aligned opposed ridges 25 and 27 which firmly engage opposite sides of the surface of the elongated article placed therein. The elongated article can readily slide into the slot, but lengthwise movement is restricted by the ridges. FIGS. 2–4 show an embodiment of the invention wherein the width of the slot is not adjustable.

Figure 7:
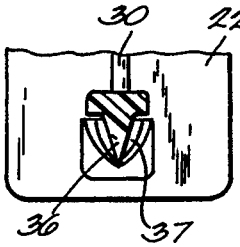
FIG. 7 is a broken away cross-sectional view taken along Line 7—7 of FIG. 5.
Figure 8:
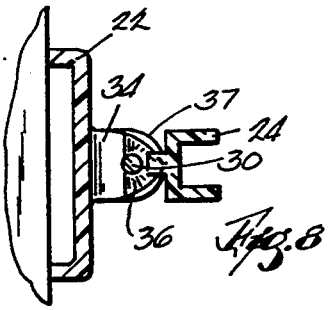
FIG. 8 is a fragmentary cross-sectional view taken along line 8—8 of FIG. 5.
Figure 9:
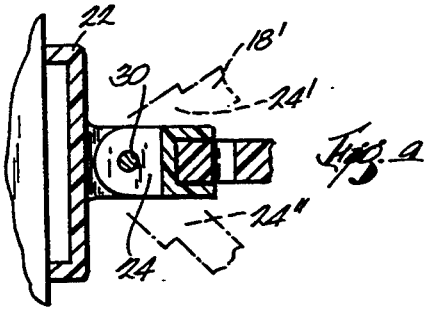
FIG. 9 is a fragmentary cross-sectional view taken along line 9—9 of FIG. 5.

Yoke 24 is pivotally mounted on plate 22 which has integrally formed with it a flange 32 having a hole 33 for receipt of pin 30. Also connected to plate 22 is a bracket 34 which holds the bottom of pin 30 and supports the bottom of yoke 24. This is best seen in FIGS. 5, 7 and 8. Bracket 34 is provided with an upward facing rounded channel 37 into which tapered corner 36 of yoke 24 is fitted. This configuration allows pivoting of yoke 24 from side-to-side as seen in FIG. 9, note 24' and 24". Thus the slot 12' can be pivoted to face to the right or left as the cord 14 is pulled. After the tension on cord 14 is released the yoke 24 returns to the central position shown in FIG. 8 by virtue of the force of gravity causing tapered end 36 to return to the bottom of channel 37.

In the preferred embodiments the top of slot 12 can be closed by means of a metal clip 40 which can be pivoted between a closed position seen in FIG. 2, wherein it is snapped into indentation 42, to an open position shown in FIG. 3. Such a closure device can be provided for convenience if it is desired to carry the dispensing device to a different location for use. This is easily accomplished by removing pin 20 and grasping the device through opening 15. In this manner the cord can be carried to a location where it is needed for dispensing. Hole 35 can be provided for convenience in hanging the dispensing device on a nail at a different location.

Figure 6:
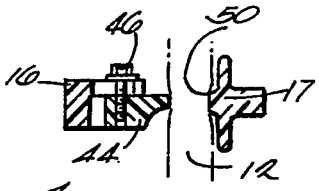
FIG. 6 is a cross-sectional view of the device of FIG. 5 taken along Line 6—6.

It is important that the width of slot 12 be just slightly less than the diameter of coiled article 14. In order to make the width of the slot adjustable a movable edge 44 can be provided on side 16 of body portion 11 as is shown in the embodiment of FIGS. 5 and 6. Adjustment is provided by means of screws 46 and 48 which enable the user to adjust the width of slot 12 so that coiled article 14 will be firmly grasped in the slot. The optimum width is achieved by setting member 44 so that coiled article 14 can slide out of the open end of slot 12 but will not easily slide in slot 12 longitudinally of the axis of the elongated article. The possibility of the elongated article becoming tightly knotted around side 17 of body portion 11 is thus avoided.

The resistance to sliding is provided in the case of the embodiment of FIGS. 5–9 by compression of the elongated article in the narrow slot formed by the narrow edge of member 44 and the raised central ridge 50 of body portion 17.

Figure 12:
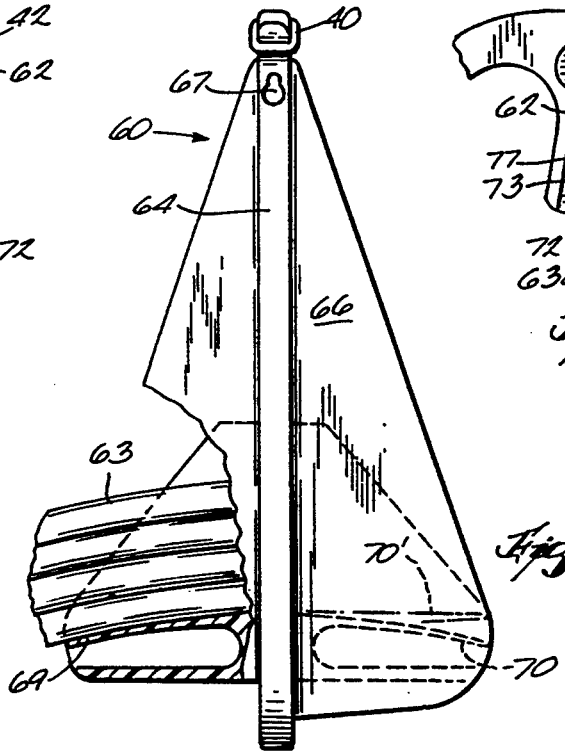
FIG. 12 is a front view of the embodiment of FIG. 10 with parts broken away in cross-section, other parts shown by phantom lines and showing a hose wound thereon.

In the embodiment of the invention illustrated in FIGS. 10–13 a storing dispensing device specifically designed for use with a garden hose is shown. Parts indicated by the same numerals as those of earlier described embodiments are similar and provide the same function. Slot 62 is defined by body portions 64 provided with laterally extending wall portions 66 and 68 on opposite sides of the slot. Said wall portions prevent hose 63 from becoming over-lapped or twisted around itself and thus ensure that a single coil of hose is formed as best seen in FIG. 12. Flexible means 69 and 70 for supporting the hose are positioned at the bottom of slot 62. The unflexed orientation 70' illustrates the unflexed position of the supporting members while the positions shown by solid lines or cross-section in FIG. 12 illustrate the manner in which supporting surfaces 69 and 70 curve to support hose 63 along their entire length. Hole 67 is provided in the event it is desired to hang the device with or without hose 63 thereon on a screw or nail at a convenient location.

In a preferred embodiment as illustrated, one of the edges of slot 62 is defined by a biased blade member 72 having a hose engaging ridge 73 along the length thereof. Ridge 73 is aligned with a corresponding ridge 70 on the opposite side of slot 62. Blade 72 is held on body portion 16 by means of pins or screws 74 and 76 which pass through supporting body portion 77. The biased edge of blade 72 is urged toward the slot by means of springs 79 positioned between members 72 and 77. Preferably these springs are concealed by being positioned in a slot in the rear of blade 72.

Figure 13:
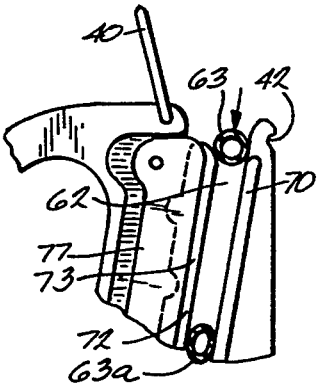
FIG. 13 is a fragmentary view of the open end of the slot of the device of FIG. 10 showing in cross-section a hose being installed thereon.
Figure 15:
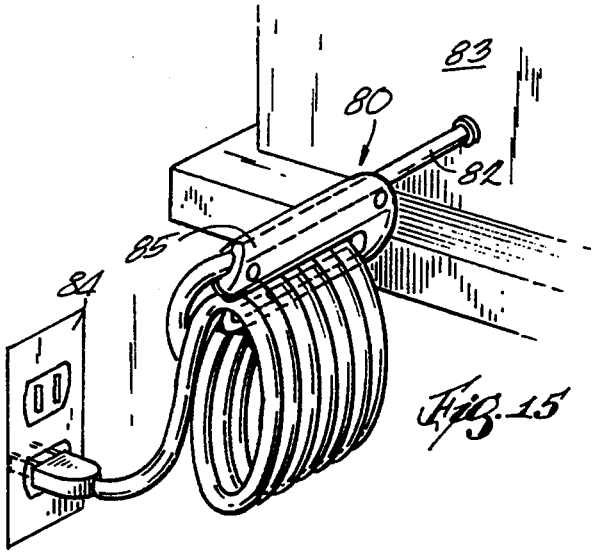
FIG. 15 is a perspective view of yet another embodiment of the invention showing an electrical cord coiled thereon attached to the rear of an electrical appliance shown in phantom.
Figure 17:
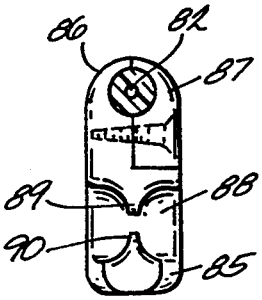
FIG. 17 is a cross-sectional view taken along line 17—17 of FIG. 16.
Figure 16:
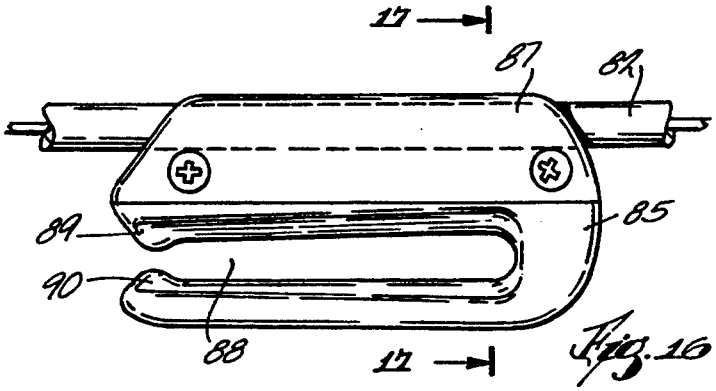
FIG. 16 is a side view of the embodiment of FIG. 15 with the ends of the electrical cord broken away.
Figure 19:
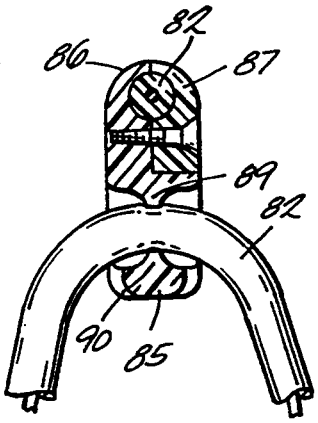
FIG. 19 is a cross-sectional view taken along line 19—19 of FIG. 18.
Figure 18:
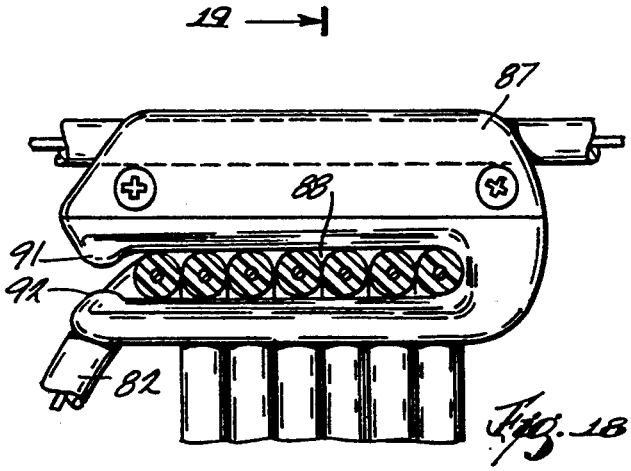
FIG. 18 is a side view showing the device of FIG. 16 with an electrical cord wound thereon.
Figure 20:
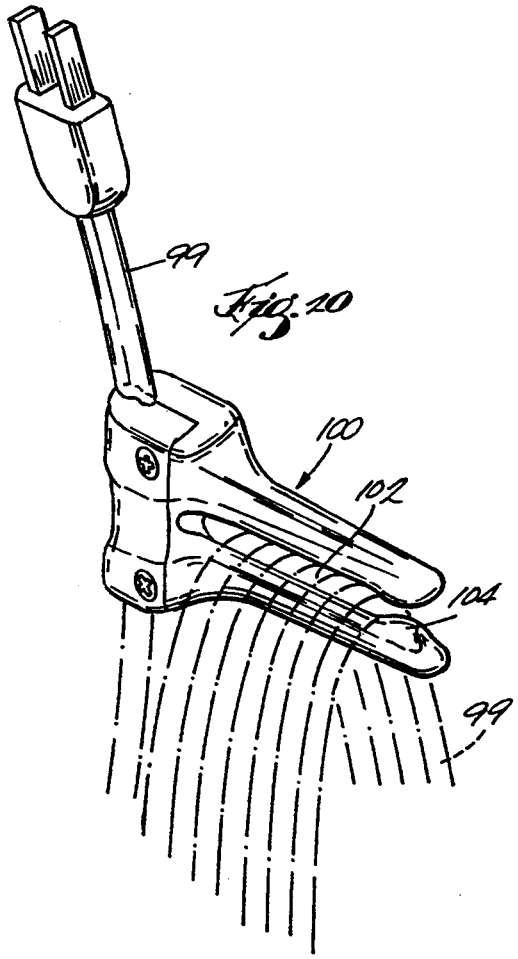
FIG. 20 is a perspective view of yet another embodiment of the invention attached to an electrical cord and with portions of the cord broken away and in phantom for clarity.
Figure 21:
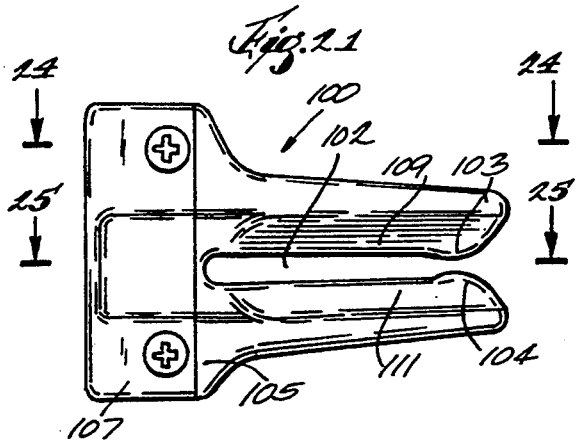
FIG. 21 is a side view of the device of FIG. 20.
Figure 23:
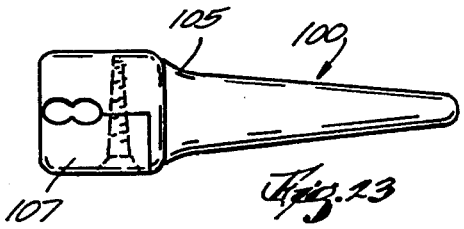
FIG. 23 is a top view of the device shown in FIG. 21.
Figure 24:
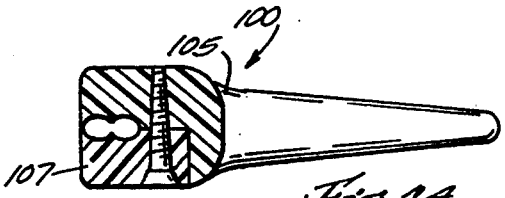
FIG. 24 is a cross-sectional view of the device of FIG. 21 taken along line 24—24.
Figure 22:
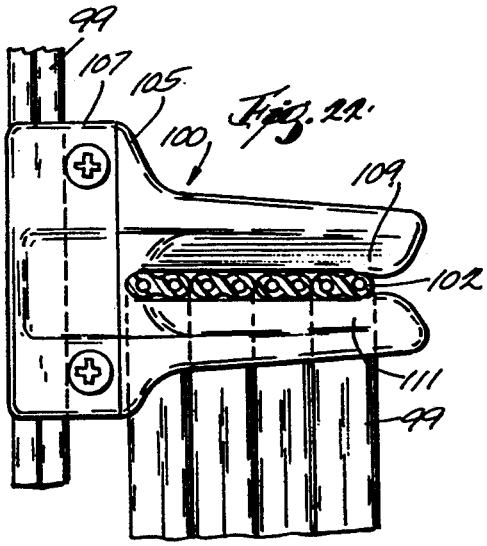
FIG. 22 shows the device of FIG. 21 attached to an electrical cord with portions of the cord wound thereon.
Figure 25:
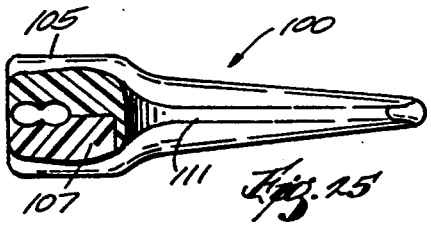
FIG. 25 is a cross-sectional view of the device of FIG. 21 taken along line 25—25.
Figure 26:
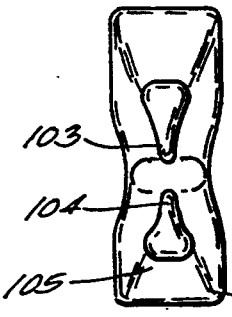
FIG. 26 is a side view of the device shown in FIG. 21 viewed from the right.

As is seen in FIG. 13 hose 63 has a normally circular configuration, which by virtue of being slightly squeezed between ridges 70 and 73, is forced into a slightly flattened oval configuration 63*a*.

Figure 14:
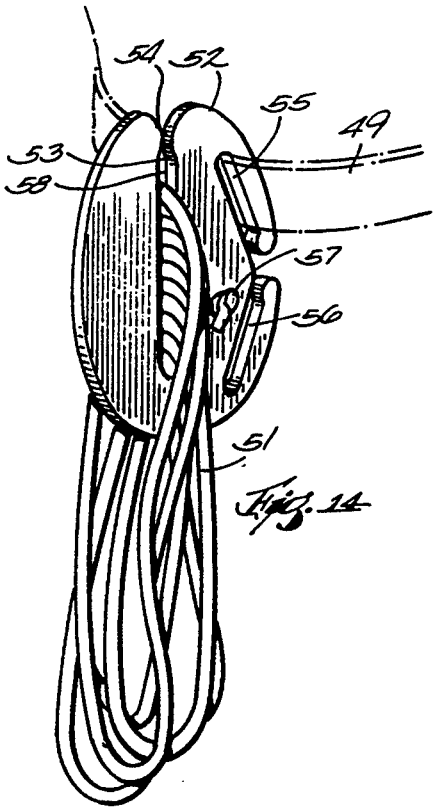
FIG. 14 is a perspective view of another embodiment of the invention showing a rope coiled thereon and showing in phantom the belt of a person on which the attached belt is worn.
Figure 11:
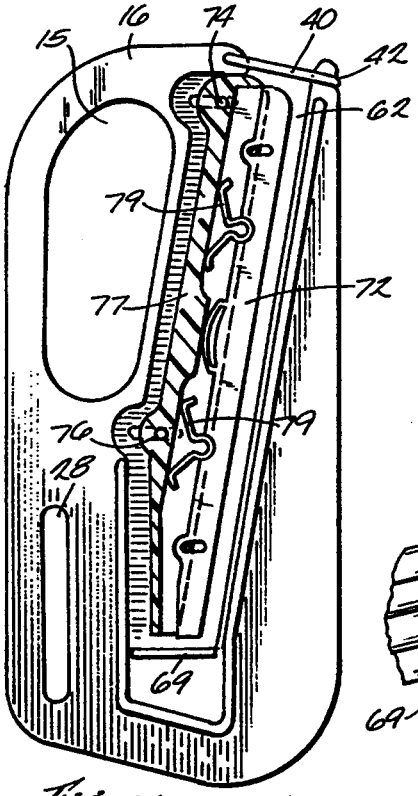
FIG. 11 is a side view of the embodiment of FIG. 10 with parts in cross-section.

In the embodiment illustrated in FIG. 14 there is shown an embodiment of the device intended for use by a hunter who desires to carry a rope 51 on his belt 49. The device 52 is provided with a slot 53 having a constricted opening 54 and inwardly facing ridges 58 which engage the surface of rope 51. If desired, a hole can be provided in the device within which to knot an end 57 of rope 51.

As seen in the device 52 with rope 51 wound thereon can be carried in an upright orientation that will tend to prevent removal of rope 51 therefrom by hanging the same on belt 49 by means of slot 55. Then, in case the user wishes to pull a firearm or other object into a tree stand or other raised perch, he can do so by tying the loose end of rope 51 to the firearm. Device 52 can then be positioned so that slot 53 is downwardly oriented by hanging device 52 on belt 49 by means of the other slot 56. This will enable gradual feeding of rope 51 from slot 53 as the user climbs to the raised perch. After climbing to the desired location, the firearm or other object can then be raised using rope 51. It will be apparent that other persons such as line repairmen, foresters, etc. who wish to raise hazardous tools or equipment to an elevated location can also use device 52.

Referring now to the embodiment of FIGS. 15–19, there is seen a device 80 intended for attachment to an electrical cord 82 which may be, for example, attached to the rear of an appliance 83. The device 80 which includes a body portion 85 provides a convenient means for holding cord 82 near the rear of appliance 83 when there is excess cord length compared to that required to reach electrical outlet 84. As in the case of the other embodiments of the invention, body portions 85 and 86 of device 80 define a slot 88 which has internally facing ridges 89 and 90 along the length thereof for engagement with the surface of electrical cord 82. It will be noted that in FIG. 19 that cord 82 can slide between ridges 89 and 90 but the same provide resistance to longitudinal movement of the cord along its axis. Body portion 86 is provided with a separable portion 87 for engagement with opposite sides of cord 82 upon which it can be clamped by means of screws as shown. The open end of slot 88 can be provided with constricted portions 91 and 92 to ensure that the cord 82 does not too easily slide out of the open end of slot 88.

FIGS. 20 through 26 show yet another embodiment similar in purpose to that shown in FIGS. 15–19. In this embodiment device 100 is configured so that it will receive a flattened-type electrical cord 99 in slot 102. Slot 102 is provided with hosed ridges 109 and 111. The body of device 100 is divided into portions 105 and 107 which can be separated and then secured around cord 99 by means of screws. The open end of slot 102 can be constricted by means of constrictions 103 and 104. In the illustrated embodiments the body of the device of the invention is formed from a molded plastic. However, a bent metal rod having a first end bent in the form of an attaching means and an opposite end being doubled back upon itself to form a slot can be utilized. In such case the rounded edges of the metal that define the slot produce a structure wherein the constricted portion of the slot is formed by the opposed rounded surfaces.

I claim:

1. A device for receiving, storing and redispensing a flexible elongated article having a circular cross-section with a generally uniform diameter comprising a body portion containing a slot for sequentially receiving single loops of the elongated article, means for attaching the device to a supporting surface, the slot having a constricted portion with the width of said slot at said portion sufficiently less than the diameter of the elongated article to restrain movement thereof along the lineal axis of the elongated article while permitting insertion and removal of the article in said slot in a direction perpendicular to said axis, said constricted portion having a thickness substantially less than the overall thickness of said body portion that defines said slot.

2. A device according to claim 1 wherein said constricted portion is centrally located in said slot.

3. A device according to claim 1 wherein said slot is provided with a restriction at the open end thereof.

4. A device according to claim 1 wherein said attaching means comprises a slot in the side of said body portion opposite said elongated article receiving slot adapted to fit over a belt worn around the waist of a user.

5. A device according to claim 4 wherein said belt engaging slot is oriented so as to hold said elongated article receiving slot in a generally vertical position with the open end oriented upwardly, and said body portion is provided with a second belt receiving slot adapted to attach said device to the belt of a user with the elongated article engaging slot pointed generally downwardly for dispensing of said elongated article.

6. A device according to claim 1 wherein said attaching means comprises a clamp adapted to be secured to opposite sides of an electrical cord.

7. A device according to claim 1 wherein said body portion comprises a molded plastic article.

8. A device according to claim 1 wherein the attaching means comprises a bracket adapted to be attached to a wall, said body portion being pivotally attached to said bracket on a vertical axis, said bracket including a bottom support for engaging a bottom edge of said body portion, said bottom support having an upwardly facing rounded channel whereby said body portion can be pivoted toward either side of said bracket and will be returned to a position normal to said bracket by the force of gravity.

9. A device for receiving, storing and redispensing a flexible elongated article having a circular cross-section with a generally uniform diameter comprising a body portion containing a slot for sequentially receiving single loops of the elongated article, means for attaching the device to a supporting surface, the slot having a constricted portion with the width of said slot at said portion sufficiently less than the diameter of the elongated article to restrain movement thereof along the lineal axis of the elongated article while permitting insertion and removal of the article in said slot in a direction perpendicular to said axis, said constricted portion having a thickness substantially less than the overall thickness of said body portion that defines said slot wherein the attaching means comprises a bracket adapted to be attached to a wall, said body portion being provided with a generally vertical slot having a closed bottom, and said attaching means being provided with a removable pin for engaging said slot said slot being pivotable about said pin and wherein raising of said device so that the bottom of said slot engages said pin enables pivoting downwardly of said device go that said article receiving slot is pivoted into a horizontal position.

10. A device according to claim 9 wherein said body portion is of a progressively increasing width toward the closed bottom of said slot.

11. A device according to claim 9 wherein a flexible flat supporting surface for the elongated article extends laterally from each side of said bottom of said slot.

12. A device for receiving, storing and redispensing a flexible elongated article having a circular cross-section with a generally uniform-diameter comprising a body portion containing a slot for sequentially receiving single loops of the elongated article, means for attaching the device to a supporting surface, the slot having a constricted portion with a slot width at said portion sufficiently less than the diameter of the elongated article to restrain movement thereof along the lineal axis of the elongated article while permitting insertion and removal of the article in said slot in a direction perpendicular to said axis, said constricted portion having a width substantially less than the overall width of the opposed body portions defining said slot, said constricted portion including at least one adjustable edge whereby the width of the slot is adjustable.

13. A device according to claim 12 wherein the adjustable edge is resiliently biased to exert a yieldable pressure on said elongated article.

14. A device according to claim 13 wherein said adjustable edge comprises a first means adjustably attached to said body, and an outwardly spring biased linear edge defining member carried by said first means.

* * * * *